US009975222B2

(12) United States Patent
Yang et al.

(10) Patent No.: US 9,975,222 B2
(45) Date of Patent: May 22, 2018

(54) RATCHET WRENCH

(71) Applicants: Chun-Wei Yang, Hang zhou (CN); Zhe-Ping Zhang, Long you County (CN)

(72) Inventors: Chun-Wei Yang, Hang zhou (CN); Zhe-Ping Zhang, Long you County (CN)

( * ) Notice: Subject to any disclaimer, the term of this patent is extended or adjusted under 35 U.S.C. 154(b) by 398 days.

(21) Appl. No.: 14/720,834

(22) Filed: May 25, 2015

(65) Prior Publication Data

US 2016/0346905 A1 Dec. 1, 2016

(51) Int. Cl.
*B25B 13/46* (2006.01)
*B25B 23/00* (2006.01)

(52) U.S. Cl.
CPC ..... *B25B 13/463* (2013.01); *B25B 23/0028* (2013.01)

(58) Field of Classification Search
CPC ..... B25B 13/463; B25B 23/0028
See application file for complete search history.

(56) References Cited

U.S. PATENT DOCUMENTS 5,860,337 A * 1/1999 Janssen ..... B25B 13/461 81/177.2
5,941,141 A * 8/1999 Whitley ..... B25B 13/461 403/93
6,000,302 A * 12/1999 Chiang ..... B25G 1/063 81/177.7
6,053,076 A * 4/2000 Barnes ..... B25B 13/461 403/103
7,146,886 B1 * 12/2006 Wu ..... B25B 13/04 81/124.6
8,245,604 B2 * 8/2012 Chen ..... B25B 23/0028 81/177.8
8,960,056 B2 * 2/2015 Lee ..... B25B 13/08 81/177.7

* cited by examiner

*Primary Examiner* — Christopher M Koehler
*Assistant Examiner* — Joel Crandall

(57) ABSTRACT

A ratchet wrench includes a head with two lugs extending therefrom, and a ratchet wheel and a pawl are received in the head. A handle has a tongue which is pivotably inserted between the two lugs, and a resilient unit is connected to the tongue. The resilient unit is engaged with a concavity in the rear side of the pawl to push the pawl to be engaged with the ratchet wheel. The handle has two blocks on the top and the bottom thereof, each block has two inclined faces which contact the end faces of the two lugs when pivoting the handle. The resilient unit is moved with the tongue so as to change the position of the pawl to decide the ratcheting direction of the ratchet wrench.

3 Claims, 5 Drawing Sheets

RATCHET WRENCH

BACKGROUND OF THE INVENTION

1. Fields of the Invention

The present invention relates to a ratchet wrench, and more particularly, to a ratchet wrench whose ratcheting directions are controlled by pivoting the handle.

2. Descriptions of Related Art

The conventional ratchet wrench disclosed in U.S. Pat. No. 8,245,602 includes a wrench head having a pawl compartment formed between a notch and a chamber of the wrench head, a drive member mounted in the chamber of the wrench head and having a ratchet gear, a pawl slidably received in the pawl compartment of the wrench head for engaging with the ratchet gear and for controlling the driving direction of the drive member by the wrench head, a handle having a pivotal coupling member mounted in the notch of the wrench head, and an actuating member attached to the pivotal coupling member and engaged with the pawl for moving the pawl to either side of the pawl compartment of the wrench head in order to determine the driving direction of the drive member by the wrench head.

The handle is resiliently connected to the pawl which contacts against the sidewall of the pawl compartment to change the direction of the pawl, and the pivotal coupling member use its sidewall to assist the pivoting action of the head. However, because the end of the handle and the pivotal coupling member are received in the head, so that the thickness of head cannot be make thick enough, therefore, the head that mounting the end of the handle and the pivotal coupling member can be broken after frequent use. During the pivoting action of the handle, the end of the handle is applied by an axial force which may affects the cap to be loosened because only a second clip is used to position the cap. The notch for receiving the end of the handle and the end of the handle require accurate machining to ensure that the end of the handle to be pivoted smoothly. Besides, the position of the pawl compartment affects the angle that the handle is to be rotated. The head provides only a limited area to have all of the notch, the pawl compartment and the chamber, it requires extra machining conditions which means high cost is involved. After a period of time of use, the wearing happened to the notch and the end of the handle affects the change of the switch of the ratcheting directions, the whole handle or head of the wrench may be replaced.

The present invention intends to provide a ratchet wrench that improves the shortcomings mentioned above.

SUMMARY OF THE INVENTION

The present invention relates to a ratchet wrench and comprises a head having two lugs extending therefrom, and a ratchet wheel and a pawl are received in the head. Each of the lug has an end face. A handle has a tongue which is pivotably inserted in the slot between the two lugs by a pivot. The slot communicates with the recess in which the pawl is located. A resilient unit is connected to the tongue and comprises a push pin and a spring which pushes the push pin to be engaged with a concavity in the rear side of the pawl such that the pawl is engaged with the ratchet wheel. The handle has two blocks on the top and the bottom thereof, each block has two inclined faces. When the handle is pivoted about the rivet until the inclined faces of the two blocks contact the end faces of the two lugs, the resilient unit is moved with the tongue so as to change the position of the pawl to decide the ratcheting direction of the ratchet wrench.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
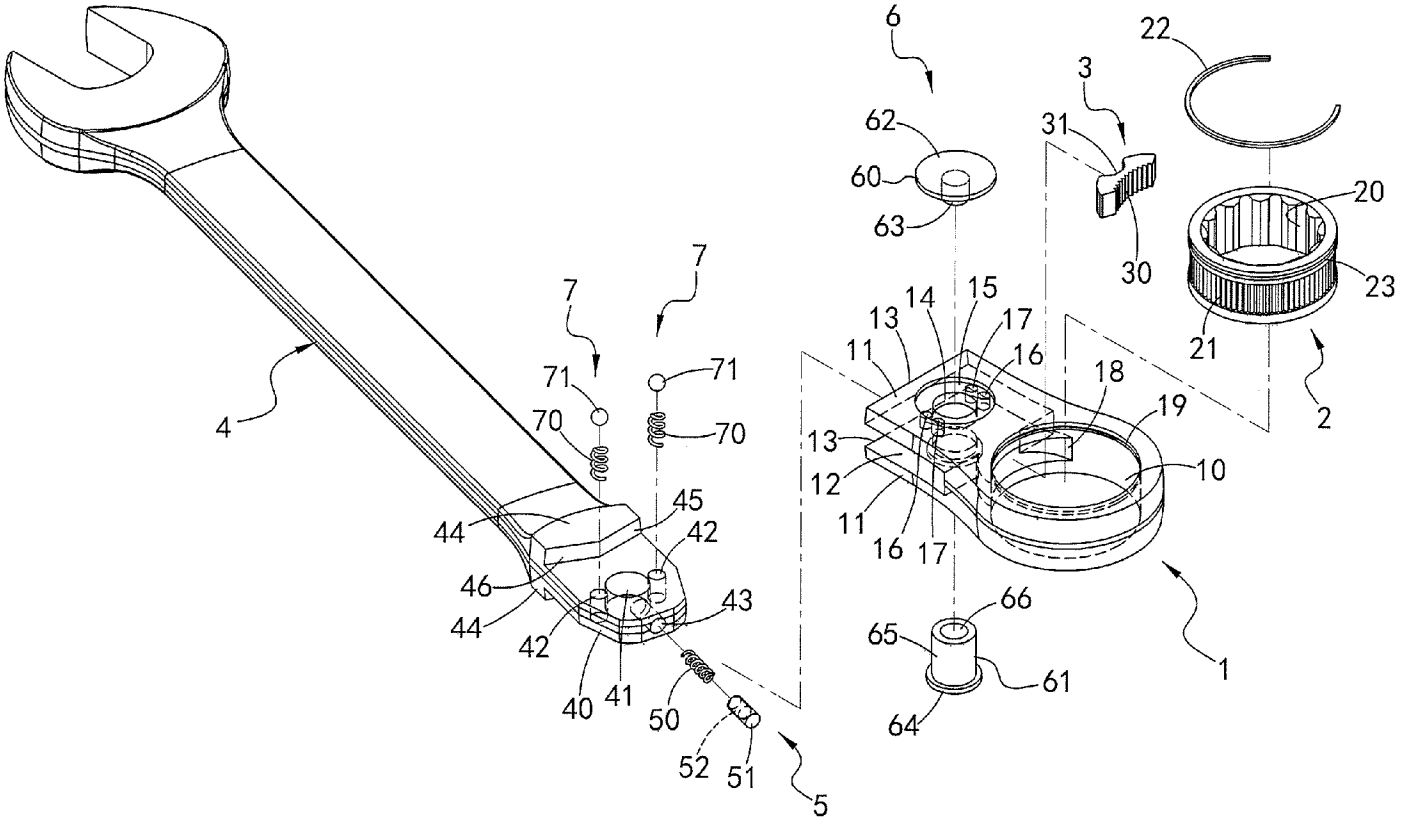
FIG. 1 is an exploded view of the ratchet wrench of the present invention.
Figure 2:
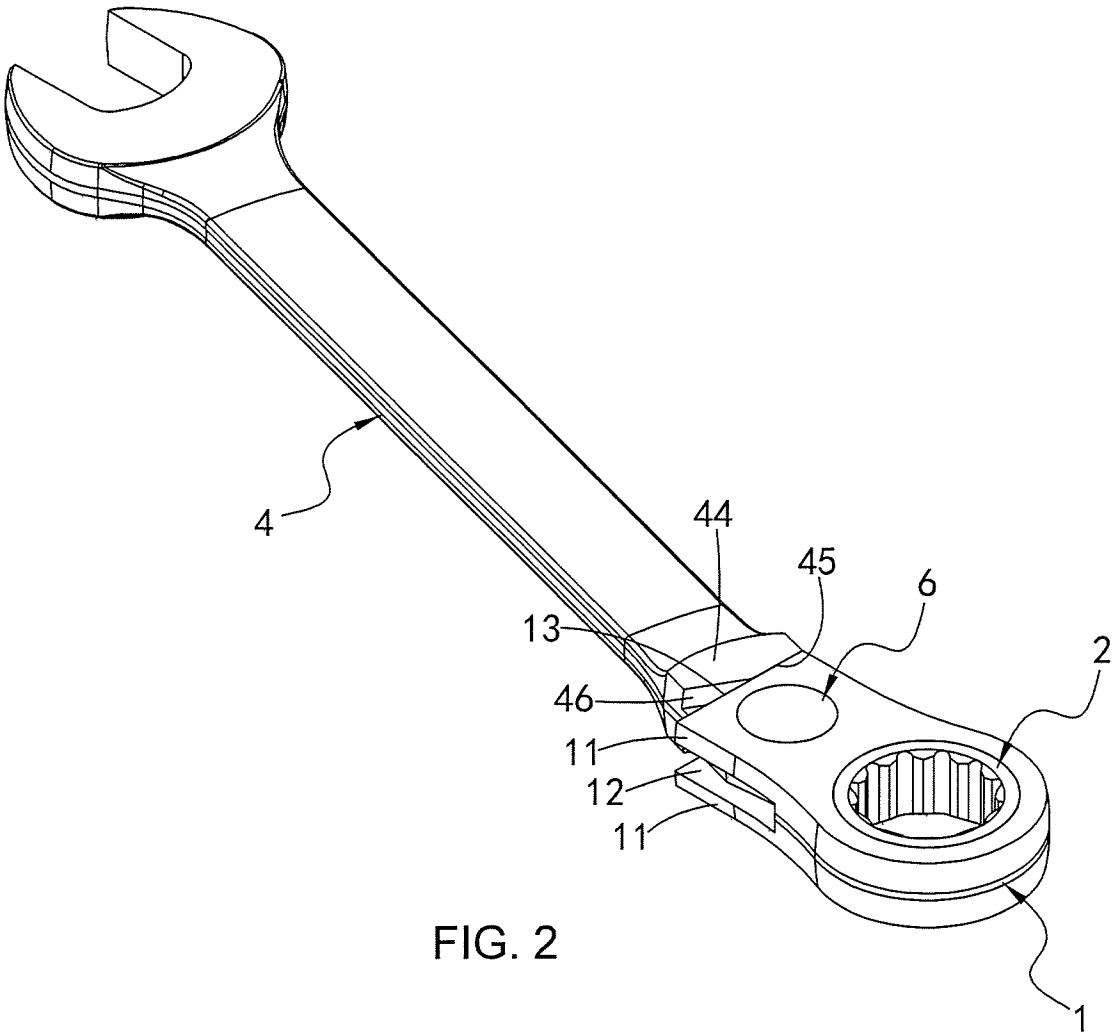
FIG. 2 is a perspective view to show the ratchet wrench of the present invention.
Figure 3:
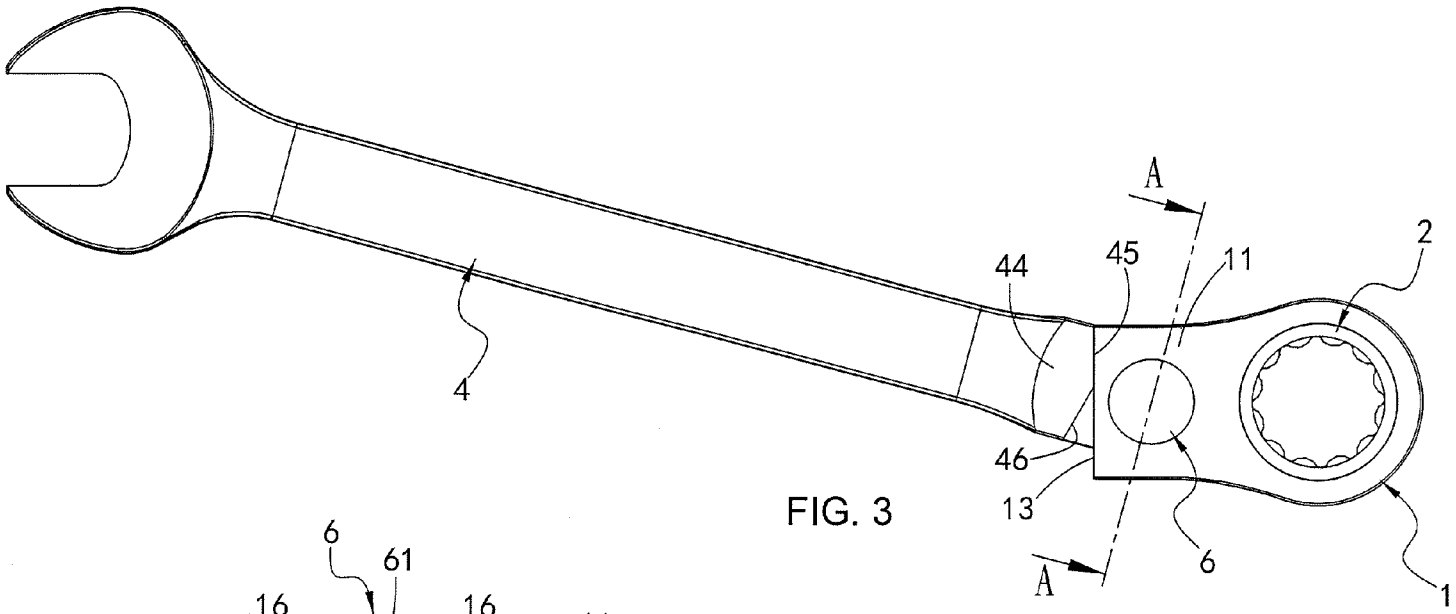
FIG. 3 is a top view of the ratchet wrench of the present invention.
Figure 4:
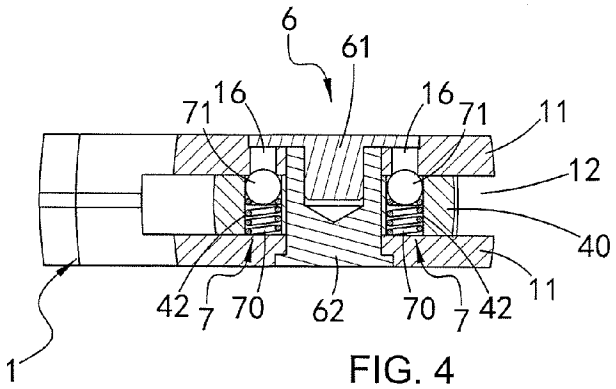
FIG. 4 is an enlarged cross sectional view, taken along line A-A in FIG. 3.

Referring to FIGS. 1 to 4, the ratchet wrench of the present invention comprises a head 1 having a through hole 10 defined through the top and the bottom thereof. Two lugs 11 extend radially from the head 1 so as to define a slot 12 between the two lugs 11. Each lug 11 has an end face 13 at the distal end thereof. A first pivot hole 14 is defined through the two lugs 11 and communicates with the slot 12. An annular sink area 15 is defined in the top of the lug 11 that is located corresponding to the top of the head 1. The sink area 15 co-axially communicates with the first pivot hole 14. The diameter of the sink area 15 is larger than that of the first pivot hole 14. The inner end of the sink area 15 has two first holes 16 and two second holes 17, wherein the first and second hole 16, 17 communicate with the slot 12. A recess 18 is defined in the inner periphery of the through hole 10 and communicates with the slot 12. The through hole 10 further has a first annular groove 19 defined in the inner periphery thereof.

A ratchet wheel 2 is located in the through hole 10 and has a driving portion 20 defined in the center thereof. Multiple ratchet teeth 21 are defined in the outer periphery of the ratchet wheel 2. The ratchet wheel 2 has a second annular groove 23 defined in the outer periphery of the ratchet wheel 2. A C-clip 22 is engaged between the first and second annular grooves 19, 23 so that the ratchet wheel 2 is rotatable in the through hole 10 and does not disengaged from the through hole 10.

A pawl 3 is movably located in the recess 18 and has multiple engaging teeth 30 defined in the front side thereof. A concavity 31 is defined in the rear side of the pawl 3.

A handle 4 has a tongue 40 extending from the first end thereof and the tongue 40 is pivotably inserted in the slot 12 by a pivot 6 which will be described later. The tongue 40 has a second pivot hole 41 and two positioning holes 42 defined through the top and the bottom thereof. A passage 43 defined in the distal end of the tongue 40 and communicates with the second pivot hole 41. Two blocks 44 respectively extend from the top and the bottom of the handle 4, and the two blocks 44 are located at the root portion of the tongue 40.

Each block 44 has a first face 45 and a second face 46 which is connected to the first face 45 at an angle so as to form an arrow-shaped arrangement.

A resilient unit 5 is located in the passage 43 and includes a spring 50 and a push pin 51, wherein the push pin 51 has a reception recess 52 so as to receive the first end of the spring 50 which pushes the push pin 51 toward outside of the passage 43 so that the push pin 51 is engaged with the concavity 31 of the pawl 3. The tongue 40 drives the push pin 51 to move the pawl 3 in the recess 18 of the head 1.

The pivot 6 has a top piece 60 and a bottom piece 61. The top piece 60 has a cap 62 and an insertion 63 which extends from the underside of the cap 62. The bottom piece 61 has a flange 64 and a tubular portion 65 which extends from the top of the flange 64. The tubular portion 65 has a reception hole 66. The tubular portion 65 extends through the first pivot hole 14 and the second pivot hole 41 from the underside of the lug 11 that is located corresponding to the bottom of the head 1. The second end of the spring 50 contacts the outside of tubular portion 65. The insertion 63 extends through the first pivot hole 14 and the second pivot hole 41 from the top of the lug 11 that is located corresponding to the top of the head 1. The insertion 63 is inserted in the reception hole 66 of the tubular portion 65. It is noted that the insertion 63 is connected to the tubular portion 66 can also be made by way of threading, snugly engagement or snapping.

Two positioning units 7 are respectively located in the two positioning holes 42, and each positioning unit 7 has a positioning spring 70 and a bead 71. Each positioning spring 70 is biased between the bead 71 and the top surface of the lug 11 located corresponding to the bottom of the head 1. The bead 71 is engaged with the first positioning hole 16 or the second positioning hole 17 when the tongue 40 is pivoted within the slot 12.

Figure 5:
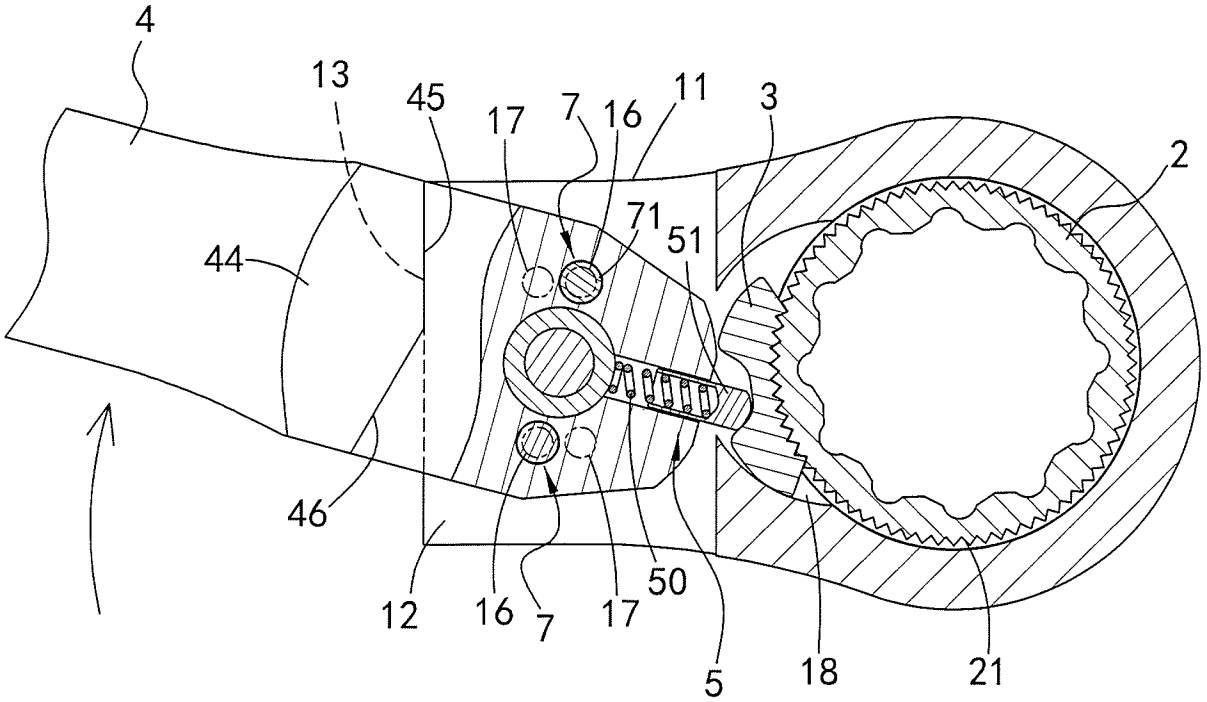
FIG. 5 is a partial cross sectional view and shows that the handle of the ratchet wrench of the present invention is pivoted clockwise.

As shown in FIG. 5, when the handle 4 is pivoted clockwise about the pivot 6, and the first faces 45 contact the end faces 13 of the two lugs 11, the beads 71 are engaged with the first holes 16. The pawl 3 is moved and pushed by the push pin 51 to be in contact with the right inside of the recess 18. Therefore, the handle 4 is rotated clockwise to drive an object (not shown) connected to the driving portion 21 of the ratchet wheel 2. When the handle rotates counter clockwise, the pawl 3 is pushed by the ratchet teeth 21 so that the push pin 51 compresses the spring 50, the ratchet wheel 2 free rotates.

Figure 6:
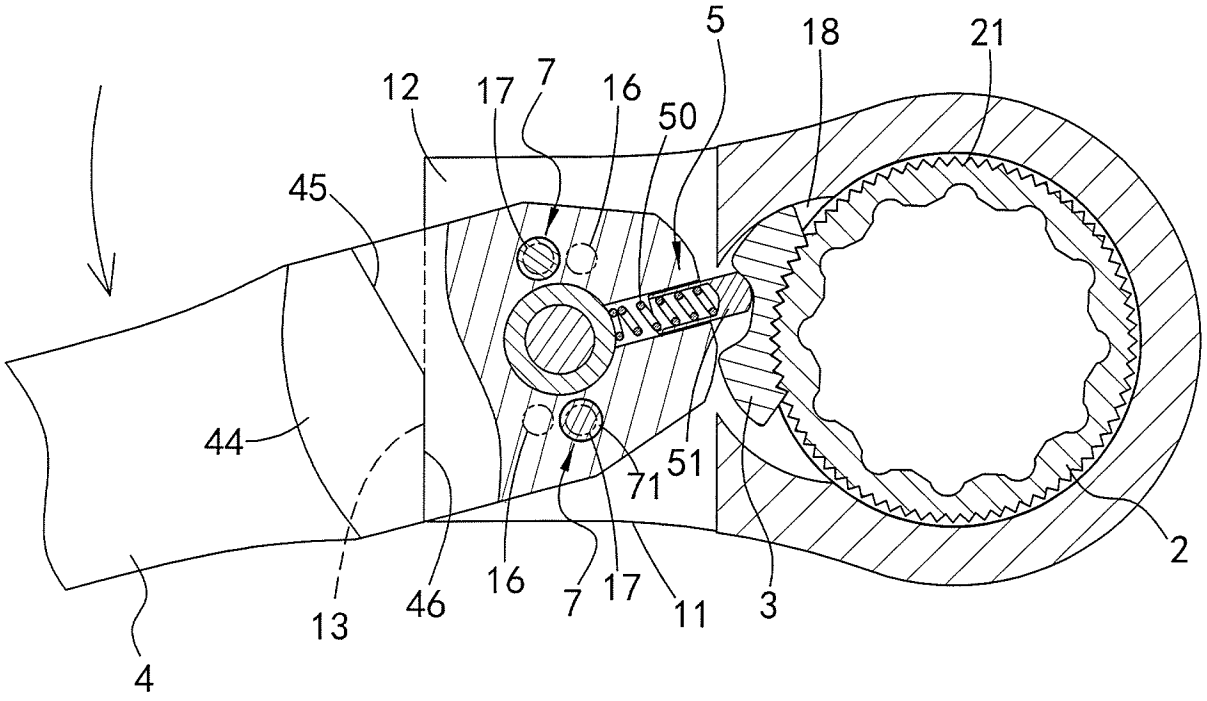
FIG. 6 is a partial cross sectional view and shows that the handle of the ratchet wrench of the present invention is pivoted counter clockwise.

As shown in FIG. 6, when the handle 4 is pivoted counter clockwise about the pivot 6, and the second faces 46 contact the other two end faces 13 of the two lugs 11, the beads 71 are moved and engaged with the second holes 17. The pawl 3 is moved and pushed by the push pin 51 to be in contact with the left inside of the recess 18. Therefore, the handle 4 is rotated counter clockwise to drive an object (not shown) connected to the driving portion 21 of the ratchet wheel 2. When the handle 4 rotates clockwise, the pawl 3 is pushed by the ratchet teeth 21 so that the push pin 51 compresses the spring 50, the ratchet wheel 2 free rotates.

The handle 4 is rotated and the ratchet wrench outputs torque when the first and second faces 45, 46 of the blocks 44 contact the end faces 13 of the lugs 11. The handle 4 can be firmly rotated to drive the object. The two lugs 11 extend from the head 1 to provide a better structure strength. The tongue 40 is pivotably connected between the two lugs 11 by the pivot 6 so that the lugs 11 are not damaged by the axial force from the tongue 40. The slot 12, the blocks 44, the first pivot hole 14, the second pivot hole 41, the first and second holes 16, 17, the positioning holes 42 and the passage 43 are easily manufactured, so that the manufacturing cost is reduced. The pivot 6 is made by the material whose hardness is less than that of the lugs 11, so that when the pivot 6 is worn out, only the pivot 6 needs to be replaced.

While we have shown and described the embodiment in accordance with the present invention, it should be clear to those skilled in the art that further embodiments may be made without departing from the scope of the present invention.

What is claimed is:

1. A ratchet wrench comprising:

a head having a through hole defined through a top and a bottom thereof, two lugs extending radially from the head and a slot defined between the two lugs, each lug having an end face, a first pivot hole defined through the two lugs and communicating with the slot, an annular sink area defined in a top of the lug located corresponding to the top of the head, the sink area co-axially communicating with the first pivot hole, a diameter of the sink area being larger than that of the first pivot hole, an inner end of the sink area having two first holes and two second holes, the first and the second hole communicating with the slot, a recess defined in an inner periphery of the through hole and communicating with the slot;

a ratchet wheel located in the through hole and having a driving portion defined in a center thereof, multiple ratchet teeth defined in an outer periphery of the ratchet wheel;

a pawl movably located in the recess and having multiple engaging teeth defined in a front side thereof, a concavity defined in a rear side of the pawl;

a handle having a tongue extending from a first end thereof and the tongue pivotably inserted in the slot, the tongue having a second pivot hole and two positioning holes defined through a top and a bottom thereof, a passage defined in a distal end of the tongue and communicating with the second pivot hole, two blocks respectively extending from a top and a bottom of the handle, the two blocks located at a root portion of the tongue, each block having a first face and a second face which is connected to the first face at an angle;

a resilient unit located in the passage and having a spring and a push pin, the push pin having a reception recess so as to receive a first end of the spring which pushes the push pin toward outside of the passage so that the push pin is engaged with the concavity of the pawl, the tongue driving the push pin to move the pawl in the recess of the head;

a pivot having a top piece and a bottom piece, the top piece having a cap and an insertion which extends from an underside of the cap, the bottom piece having a flange and a tubular portion which extends from a top of the flange, the tubular portion having a reception hole, the tubular portion extending through the first pivot hole and the second pivot hole from an underside of the lug that is located corresponding to the bottom of the head, a second end of the spring contacting the tubular portion, the insertion extending through the first pivot hole and the second pivot hole from the top of the lug located corresponding to the top of the head, the insertion inserted in the reception hole of the tubular portion, when the handle is pivoted about the pivot, and the first faces or the second faces contact respective end faces of the two lugs, the pawl is moved and contacts an inside of the recess by the resilient unit, and two positioning units respectively located in the two positioning holes and each positioning unit having a positioning spring and a bead, each positioning spring being biased between each bead respectively and a top surface of the lug located corresponding to the bottom of the head, each bead being engaged with the first hole respectively or the second hole respectively when the tongue is pivoted within the slot.

2. The ratchet wrench as claimed in claim 1, wherein the through hole has a first annular groove defined in the inner periphery thereof, the ratchet wheel has a second annular groove defined in the outer periphery of the ratchet wheel, a C-clip is engaged between the first and second annular grooves so that the ratchet wheel is rotatable in the through hole.

3. The ratchet wrench as claimed in claim 1, wherein the insertion is connected to the tubular portion by way of threading.

* * * * *